US006914042B2

(12) United States Patent
Gregory et al.

(10) Patent No.: US 6,914,042 B2
(45) Date of Patent: Jul. 5, 2005

(54) SOLID FABRIC CONDITIONING COMPOSITIONS

(75) Inventors: Denis James Gregory, Merseyside (GB); Sarah Wylde, Merseyside (GB)

(73) Assignee: Unilever Home & Personal Care USA, a division of Conopco, Inc., Greenwich, CT (US)

( * ) Notice: Subject to any disclaimer, the term of this patent is extended or adjusted under 35 U.S.C. 154(b) by 160 days.

(21) Appl. No.: 10/402,308

(22) Filed: Mar. 28, 2003

(65) Prior Publication Data

US 2003/0191042 A1 Oct. 9, 2003

(30) Foreign Application Priority Data

Mar. 28, 2002 (GB) ..... 0207481

(51) Int. Cl.[7] ..... C11D 1/835
(52) U.S. Cl. ..... 510/516
(58) Field of Search ..... 510/516

(56) References Cited

U.S. PATENT DOCUMENTS

| | | | | | |
|---|---|---|---|---|---|
| 3,936,537 | A | * | 2/1976 | Baskerville et al. | 510/330 |
| 4,196,104 | A | * | 4/1980 | Oguagha | 510/330 |
| 4,259,217 | A | * | 3/1981 | Murphy | 510/345 |
| 4,339,335 | A | | 7/1982 | Wixon | |
| 4,427,558 | A | | 1/1984 | David | |
| 4,510,073 | A | | 4/1985 | Hara et al. | |
| 4,814,095 | A | | 3/1989 | Puchta et al. | |
| 5,259,964 | A | | 11/1993 | Chavez et al. | |
| 5,674,831 | A | | 10/1997 | Schulz et al. | |
| 5,698,513 | A | | 12/1997 | Schulz et al. | |

FOREIGN PATENT DOCUMENTS

| | | |
|---|---|---|
| DE | 44 05 930 A | 5/1975 |
| DE | 24 54 465 A | 8/1995 |
| EP | 0 111 074 | 4/1990 |
| EP | 0 234 082 | 8/1990 |
| EP | 0 547 722 | 6/1993 |
| EP | 0 547 723 | 6/1993 |
| EP | 0 259 982 | 8/1993 |
| EP | 0 568 297 | 11/1993 |
| GB | 1 591 515 | 6/1981 |
| GB | 2 124 644 | 2/1984 |
| GB | 2 140 820 | 12/1984 |
| GB | 2 141 730 | 1/1985 |
| GB | 2 366 801 | 3/2002 |
| JP | 59 008800 | 5/1983 |
| JP | 60 088098 | 10/1983 |
| JP | 59 024900 | 2/1984 |
| JP | 63 008493 | 1/1988 |
| JP | 64 001800 | 6/1988 |
| JP | 64 001795 | 6/1989 |
| JP | 64 001797 | 6/1989 |
| WO | 92/18593 | 10/1992 |
| WO | 95/27769 | 10/1995 |

OTHER PUBLICATIONS

*International Search Report No. PCT/EP 03/02105 dated Jul. 29, 2003, 5 pp.*
WPI Acc.No. 1995–303032/199540 Derwent Abstract of DE 44 05 930 A.
WPI Acc.No. 1976–40335X/197622 Derwent Abstract of DE 24 54 465 A.
Abstract 233678G XP000056939 of JP 64 001795.
Abstract 233679H XP000056938 of JP 64 001797.
Abstract 233683E XP000056934 of JP 64 001800.
*UK Search Report No. GB 0207481.3 dated Sep. 12, 2002, 1 page .*
WPI Acc.No. 1988–052903 Abstract of JP 63 008493.
WPI Acc.No. 1985–156403 Abstract of JP 60 088098.
WPI Acc.No. 1984–019066 Abstract of JP 59 008800.

* cited by examiner

*Primary Examiner*—John R. Hardee
(74) *Attorney, Agent, or Firm*—Ellen Plotkin

(57) ABSTRACT

A solid fabric conditioning composition comprises from 15 to 75% by weight of cationic softening material (active ingredient), based on the total weight of the composition; one or more carrier materials and 50% or less by weight of the composition of one or more zeolites.

5 Claims, No Drawings

SOLID FABRIC CONDITIONING COMPOSITIONS

FIELD OF THE INVENTION

The present invention relates to solid fabric conditioning compositions and more particularly to solid fabric conditioning compositions which disperse well in water and/or have good flow properties when solid.

BACKGROUND OF THE INVENTION

Traditionally, fabric conditioning has been carried out either during the rinsing step of a fabric washing and rinsing process or during tumble drying of the fabric. Typically, rinse conditioning is accomplished by adding a liquid dispersion of a rinse conditioning agent to the rinse liquor. The liquid dispersion was traditionally distributed and made available to consumers as a ready to use aqueous dispersion. More recently, concern for the environment and consumer convenience has led to the sale of concentrated aqueous dispersions which are either used in smaller amounts or are mixed with water to form a dilute composition before use.

In EP 234082 it has been proposed to supply rinse conditioner as a solid block. This approach requires the use of a special restraint for the block and may also require the modification of the washing machine enable the block to be dissolved and dispensed by a spray system.

Various proposals have been made to supply fabric softener in granular or powdered form.

EP 111074 discloses a powdered rinse conditioner based on a silica carrier for the softening agent. A disadvantage of using a carrier such as silica is that it can cause bulking of the product and appears to serve no function beyond making the powder compatible with other ingredients that may be contained in a washing powder.

WO 92/18593 describes a granular fabric softening composition comprising a nonionic fabric softener and a single long alkyl chain cationic material. The specification teaches that effective cationic softening compositions when used in granular form exhibit poor dispersion properties and so, despite the obvious environmental and transport saving advantages of selling a water free powdered rinse conditioner, manufacturers have not done so.

EP-B1-0568297 discloses a powdered rinse conditioner comprising a water insoluble cationic active and a nonionic dispersing agent.

It is known that solid fabric conditioners can be formed by combining quaternary ammonium compounds with a water soluble carrier such as urea. The problem is that these products often do not have good flow properties and/or do not disperse well in liquids.

U.S. Pat. No. 5,259,964 (Colgate-Palmolive) discloses a free flowing spray-dried rinse conditioner. U.S. Pat. No. 4,427,558 (Unilever) discloses a method of preparing fabric softening particles comprising a cationic fabric conditioning material, urea and a salt of a fatty acid.

It is also known to provide zeolite as a builder for a detergent powder compositions. Quaternary ammonium materials are disclosed in such compositions typically for giving softness in the wash benefits.

JP 63008493 discloses detergent compositions comprising from 0.5 to 10 wt % of a cationic quaternary ammonium materials in combination with zeolite.

JP 60088098 discloses granular detergent compositions containing urea and anionic surfactant. A zeolite may be present.

Rinse conditioners which comprise a quaternary ammonium material in combination with a zeolite are disclosed in GB 2124644, JP 59008800, JP 59024800 and U.S. Pat. No. 4,510,073 (all Lion).

EP-A1-269982 discloses a post-wash conditioner composition comprising, by weight, (a) 5–80% of at least one natural and/or synthetic layer silicate, (b) 1–20% of at least one known neutralisation agent and acidification agent such as citric acid, malic acid, oxalic acid, lactic acid or toluenesulphonic acid (c) 1–20% of at least one known disintegration agent such as citric acid bicarbonate (d) 1–30% of at least one extender or carrier substance such as $(NH_4)_2SO_4$, zeolite A or urea, (e) 0–50% of at least one binder and (f) 0–10% of a fatty acid ester.

There is no disclosure of zeolite being used in solid fabric conditioning compositions to improve dispersion of a quaternary ammonium fabric softening material and/or to provide good flow properties of the solid even across a wide range of levels of the softening active in the composition.

GB-A-2366801 relates to solid detergent compositions comprising clay fabric softeners. The cationic surfactants disclosed are single long chain quaternary ammonium materials typically used for detergency boosting.

GB-A-2141730 and GB-A-2140820 both disclose a particulate perfume-containing carrier for laundry compositions containing at least 75% of a clay mineral or a zeolite.

GB-A-2124644 discloses a method for granulating cationic surfactants. Example 1 describes a composition comprising 100 parts of a quaternary ammonium salt, 20 parts of silica, 45 parts of aqueous Liponox NCH solution and 70 parts of zeolite. There is no mention of a carrier material.

GB-A-1591515 and U.S. Pat. No. 4,339,335 both refer to free-flowing, high bulk density, particulate, detergent fabric softener compositions comprising from 4 to 12% of a non-ester linked cationic softening agent.

Surprisingly, we have now found that the incorporation of a zeolite into a solid fabric conditioning composition based on a cationic fabric softener and a carrier, such as urea, provides excellent powder properties, for example the ability to flow freely, and better dispersion of the cationic softener in water.

Further advantages are that the solid, and particularly powder, compositions of the present invention have an attractive appearance both as a solid and when dispersed in liquid.

OBJECTS OF THE INVENTION

The present invention seeks to address one or more of the aforementioned problems and to provide one or more of the aforementioned benefits.

STATEMENT OF INVENTION

Thus, according to the present invention there is provided a solid fabric conditioning composition comprising:

(a) from 15 to 75% bv weight of cationic softening material (active ingredient), based on the total weight of the composition;

(b) one or more carrier materials;

(c) 50% or less by weight of the composition of one or more zeolites.

DETAILED DESCRIPTION OF THE INVENTION

Cationic Fabric Softener

The cationic softener is preferably a quaternary ammonium fabric softening material.

The quaternary ammonium fabric softening material compound has two $C_{12-28}$ alkyl or alkenyl groups connected to the nitrogen head group, preferably via at least one ester link. It is more preferred if the quaternary ammonium material has two ester links present.

Preferably, the average chain length of the alkyl or alkenyl group is at least $C_{14}$, more preferably at least $C_{16}$. Most preferably at least half of the chains have a length of $C_{18}$.

It is generally preferred if the alkyl or alkenyl chains are predominantly linear.

The first group of cationic fabric softening compounds for use in the invention is represented by formula (I):

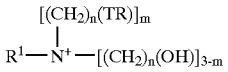

(I)

wherein each R is independently selected from a $C_{5-35}$ alkyl or alkenyl group, $R^1$ represents a $C_{1-4}$ alkyl, $C_{2-4}$ alkenyl or a $C_{1-4}$ hydroxyalkyl group, T is

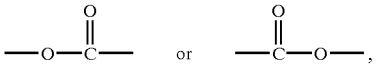

n is 0 or a number selected from 1 to 4, m is 1, 2 or 3 and denotes the number of moieties to which it relates that pend directly from the N atom, and $X^-$ is an anionic group, such as halides or alkyl sulphates, e.g. chloride, methyl sulphate or ethyl sulphate.

Especially preferred materials within this formula are di-alkenyl esters of triethanol ammonium methyl sulphate. Commercial examples include Tetranyl AHT-1 (di-hardened oleic ester of triethanol ammonium methyl sulphate 80% active), AT-1 (di-oleic ester of triethanol ammonium methyl sulphate 90% active), L5/90 (palm ester of triethanol ammonium methyl sulphate 90% active), all ex Kao. Other unsaturated quaternary ammonium materials include Rewoquat WE15 ($C_{10}$–$C_{20}$ and $C_{16}$–$C_{18}$ unsaturated fatty acid reaction products with triethanolamine dimethyl sulphate quaternised 90% active), ex Witco Corporation.

The second group of cationic fabric softening compounds for use in the invention is represented by formula (II):

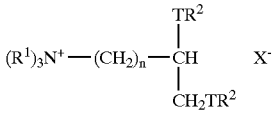

Formula (II)

wherein each $R^1$ group is independently selected from $C_{1-4}$ alkyl, hydroxyalkyl or $C_{2-4}$ alkenyl groups; and wherein each $R^2$ group is independently selected from $C_{8-28}$ alkyl or alkenyl groups; n is 0 or an integer from 1 to 5 and T and $X^-$ are as defined above.

Preferred materials of this class such as 1,2 bis [tallowoyloxy]-3-trimethylammonium propane chloride and 1,2-bis[oleyloxy]-3-trimethylammonium propane chloride and their method of preparation are, for example, described in U.S. Pat. No. 4,137,180 (Lever Brothers), the contents of which are incorporated herein. Preferably these materials also comprise small amounts of the corresponding monoester, as described in U.S. Pat. No. 4,137,180.

A third group of cationic fabric softening compounds for use in the invention is represented by formula (III):

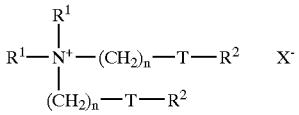

(III)

wherein each $R^1$ group is independently selected from $C_{1-4}$ alkyl, or $C_{2-4}$ alkenyl groups; and wherein each $R^2$ group is independently selected from $C_{8-28}$ alkyl or alkenyl groups; n is 0 or an integer from 1 to 5 and T and $X^-$ are as defined above.

A fourth group of cationic fabric softening compounds for use in the invention is represented by formula (IV):

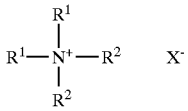

(IV)

wherein each $R^1$ group is independently selected from $C_{1-4}$ alkyl, or $C_{2-4}$ alkenyl groups; and wherein each $R^2$ group is independently selected from $C_{8-28}$ alkyl or alkenyl groups; and $X^-$ is as defined above.

Where the quaternary ammonium raw material is provided in a solvent, it is particularly preferred that the solvent is evaporated off to give a solid product which is then milled to give a powder of the quaternary ammonium material of mean particle size within the range 100 to 1200 $\mu$m, more preferably from 200 to 1000 $\mu$m, most preferably from 300 to 800 $\mu$m, e.g. 400 to 600 $\mu$m.

The compositions comprise from 15 to 75% by weight of cationic softening material (active ingredient), based on the total weight of the composition, preferably 17 to 70% by weight, more preferably 19 to 60% by weight, most preferably 22 to 45% by weight.

Iodine Value of the Parent Fatty Acyl Group or Acid

The iodine value of the parent fatty acyl compound or acid from which the cationic softening material is formed is from 0 to 140, preferably from 0 to 100, more preferably from 0 to 60.

It is especially preferred that the iodine value of the parent compound is from 0 to 20, e.g. 0 to 5. Where the iodine value is 5 or less, the softening material provides excellent softening results and has improved resistance to oxidation and associated odour problems upon storage.

In the context of the present invention, iodine value of the parent fatty acyl compound or acid from which the cationic surfactant is formed, is defined as the number of grams of iodine which react with 100 grams of the compound.

One method for calculating the iodine value of a parent fatty acyl compound/acid from which the cationic softening compound is formed, comprises dissolving a prescribed amount (from 0.1–3 g) into about 15 ml chloroform. The dissolved parent fatty acyl compound/fatty acid is then reacted with 25 ml of iodine monochloride in acetic acid solution (0.1M). To this, 20 ml of 10% potassium iodide solution and about 150 ml deionised water is added. After addition of the halogen has taken place, the excess of iodine monochloride is determined by titration with sodium thiosulphate solution (0.1M) in the presence of a blue starch indicator powder. At the same time a blank is determined with the same quantity of reagents and under the same conditions. The difference between the volume of sodium thiosulphate used in the blank and that used in the reaction with the parent fatty acyl compound or fatty acid enables the iodine value to be calculated. Other methods for calculating the IV of a parent fatty acyl compound or fatty acid of a softening compound will be apparent to the person skilled in the art.

Carrier Material

The solid composition comprises a carrier material. Preferred carrier materials are those which aid the preparation of a dry, free-flowing powder which disperses readily in water.

Especially preferred carriers are urea-based. The most preferred carrier is urea since it is a simple, easily available product which enables production of a fabric conditioning composition without recourse to expensive carriers.

Other suitable carriers include water soluble inorganic salts such as sodium chloride, potassium chloride, magnesium chloride, sodium sulphate, potassium sulphate, magnesium sulphate, sodium carbonate and sodium sesquicarbonate.

The carrier may also comprise a mixture of one or more the aforementioned salts.

The carrier material is preferably present in an amount from 10 to 95% by weight, more preferably 25 to 85% by weight, most preferably 40 to 70% by weight, based on the total weight of the composition.

Zeolite

The compositions of the invention comprise a zeolite. Preferred zeolites include alkali metal, preferably sodium, aluminosilicates.

Zeolites may be incorporated in amounts of from 0.1 to 50% by weight (anhydrous basis), preferably from 1 to 30 wt %, based on the total weight of the composition.

The zeolite is not present in an amount greater than 50% by weigh, based on the total weight of the composition, since the resultant solid has poor flow properties, e.g. the particle size is so small that the product is in the form of a dust.

The zeolite may be either crystalline or amorphous or mixtures thereof, having the general formula:

$$0.8\text{–}1.5\ Na_2O.\ Al_2O_3.\ 0.8\text{–}6\ SiO_2$$

These materials contain some bound water and should have a calcium ion exchange capacity of at least 50 mg CaO/g. The preferred sodium aluminosilicates contain 1.5–3.5 $SiO_2$ units (in the formula above). Both the amorphous and the crystalline materials can be prepared readily by reaction between sodium silicate and sodium aluminate, as is typical is the art.

Suitable crystalline sodium aluminosilicate ion-exchange detergency builders are described, for example, in GB 1 429 143 (Procter & Gamble). The preferred sodium aluminosilicates of this type are the well-known commercially available zeolites A and X, and mixtures thereof.

A particularly preferred zeolite is zeolite 4A.

It has been found that the solid compositions of the present invention, which comprise a cationic softener and a carrier, such as urea, have excellent flow properties (typically exhibiting flow rates of 90 ml/s or more, more preferably 100 ml/s or more, most preferably 110 ml/s or more).

However, in the absence of zeolite, such flow rates are only achieved across a narrow wt % range of the cationic softener. By incorporating a zeolite into the composition, the excellent flow properties can be achieved over a much broader wt % range of the cationic softener.

In particular, it has been found that the presence of the zeolite enables much higher levels of the cationic softener to be present in the composition without detrimentally affecting the flow properties of the solid.

In use, when the solid composition is added to liquid, e.g. water, the zeolite rapidly disperses to give a milky solution. Although not essential to the invention, this provides a highly desirable attractive appearance to the composition.

Fatty Alcohol

Optionally and advantageously, one or more un-alkoxylated fatty alcohols are present in the composition.

Preferred alcohols have a hydrocarbyl chain length of from 10 to 22 carbon atoms, more preferably 11 to 20 carbon atoms, most preferably 15 to 19 carbon atoms.

The fatty alcohol may be saturated or unsaturated, though saturated fatty alcohols are preferred as these have been found to deliver greater benefits in terms of stability, especially low temperature stability.

Suitable commercially available fatty alcohols include tallow alcohol (available as Hydrenol S3, ex Sidobre Sinnova, and Laurex CS, ex Clariant).

The fatty alcohol content in the compositions is from 0 to 10% by weight, more preferably from 0.005 to 5% by weight, most preferably from 0.01 to 3% by weight, based on the total weight of the composition.

Flow Aid

A flow aid is optionally present in the compositions of the invention.

The flow aid preferably comprises a fine particulate material which coats the solid, e.g. powder granules, providing improvements in storage and handling properties.

Preferred flow aids are the commercially available sodium aluminosilicates, zeolite A, zeolite MAP and Alusil.

Of course, if the flow aid is a zeolite it may also act as a carrier for the cationic softening material.

The flow aid is preferably present in an amount from 0.001% to 10% by weight, more preferably from 0.01% to 5% by weight, most preferably from 0.1% to 2% by weight, based on the total weight of the composition. If the flow aid is a zeolite, higher levels may be present.

The flow aid is typically the final ingredient to be added to the composition once the solid is substantially already formed.

Deposition Aid

Preferably the compositions of the invention further comprise a deposition aid for improving deposition of the cationic softener onto fabrics.

It has surprisingly been found that certain salts can be used as deposition aids for solid fabric conditioning compositions.

Preferably the deposition aid comprises a water soluble salt. By water soluble, it is meant that the salt has a solubility in excess of 1 gram per liter, preferably in excess of 25 grams per liter. Suitable salts include sulphates, citrates, oxalates, phosphates and halides, most preferably chloride.

The counter ion is preferably an alkaline earth metal, ammonium or alkali metal. Preferably, it comprises an alkali metal cation or ammonium. Typically preferred are sodium, potassium or ammonium salts. There may be more than one salt present, and they may differ in the choice of anion, cation or both.

A preferred deposition aid is a salt of citric acid, such as sodium citrate.

The deposition aid is preferably present in an amount from 0.001% 20% by weight, more preferably from 0.01% to 10% by weight, most preferably rom 0.1% to 5% by weight, based on the total weight of the composition.

Nonionic Surfactants

It is preferred that the compositions further comprise a nonionic surfactant. Typically these can be included for the purpose of stabilising the compositions.

Suitable nonionic surfactants include addition products of ethylene oxide and/or propylene oxide with fatty alcohols, fatty acids and fatty amines.

Any of the alkoxylated materials of the particular type described hereinafter can be used as the nonionic surfactant.

Suitable surfactants are substantially water soluble surfactants of the general formula:

$$R_Y_(C_2H_4O)_z_C_2H_4OH$$

where R is selected from the group consisting of primary, secondary and branched chain alkyl and/or acyl hydrocarbyl groups; primary, secondary and branched chain alkenyl hydrocarbyl groups; and primary, secondary and branched chain alkenyl-substituted phenolic hydrocarbyl groups; the hydrocarbyl groups having a chain length of from 8 to about 25, preferably 10 to 20, e.g. 14 to 18 carbon atoms.

In the general formula for the ethoxylated nonionic surfactant, Y is typically:

—O—, —C(O)O—, —C(O)N(R)— or —C(O)N(R)R— in which R has the meaning given above or can be hydrogen; an Z is at least about 8, preferably at least about 10 or 11.

Preferably the nonionic surfactant has an HLB of from about 7 to about 20, more preferably from 10 to 18, e.g. 12 to 16.

Examples of nonionic surfactants follow. In the examples, the integer defines the number of ethoxy (EO) groups in the molecule.

A. Straight-Chain, Primary Alcohol Alkoxylates

The deca-, undeca-, dodeca-, tetradeca-, and pentadeca-ethoxylates of n-hexadecanol, and n-octadecanol having an HLB within the range recited herein are useful viscosity/dispersibility modifiers in the context of this invention. Exemplary ethoxylated primary alcohols useful herein as the viscosity/dispersibility modifiers of the compositions are $C_{18}$ EO(10); and $C_{18}$ EO(11). The ethoxylates of mixed natural or synthetic alcohols in the "tallow" chain length range are also useful herein. Specific examples of such materials include tallow alcohol-EO(11), tallow alcohol-EO (18), and tallow alcohol-EO(25), coco alcohol-EO(10), coco alcohol-EO(15), coco alcohol-EO(20) and coco alcohol-EO (25).

B. Straight-Chain, Secondary Alcohol Alkoxylates

The deca-, undeca-, dodeca-, tetradeca-, pentadeca-, octadeca-, and nonadeca-ethoxylates of 3-hexadecanol, 2-octadecanol, 4-eicosanol, and 5-eicosanol having an HLB within the range recited herein are useful viscosity and/or dispersibility modifiers in the context of this invention. Exemplary ethoxylated secondary alcohols useful herein as the viscosity and/or dispersibility modifiers of the compositions are: $C_{16}$ EO(11); $C_{20}$ EO(11); and $C_{16}$ EO(14).

C. Alkyl Phenol Alkoxylates

As in the case of the alcohol alkoxylates, the hexa- to octadeca-ethoxylates of alkylated phenols, particularly monohydric alkylphenols, having an HLB within the range recited herein are useful as the viscosity and/or dispersibility modifiers of the instant compositions. The hexa- to octadeca-ethoxylates of p-tri-decylphenol, m-pentadecylphenol, and the like, are useful herein. Exemplary ethoxylated alkylphenols useful as the viscosity and/or dispersibility modifiers of the mixtures herein are: p-tridecylphenol EO(11) and p-pentadecylphenol EO(18).

As used herein and as generally recognized in the art, a phenylene group in the nonionic formula is the equivalent of an alkylene group containing from 2 to 4 carbon atoms. For present purposes, nonionics containing a phenylene group are considered to contain an equivalent number of carbon atoms calculated as the sum of the carbon atoms in the alkyl group plus about 3.3 carbon atoms for each phenylene group.

D. Olefinic Alkoxylates

The alkenyl alcohols, both primary and secondary, and alkenyl phenols corresponding to those disclose immediately hereinabove can be ethoxylated to an HLB within the range recited herein and used as the viscosity and/or dispersibility modifiers of the instant compositions.

E. Branched Chain Alkoxylates

Branched chain primary and secondary alcohols which are available from the well-known "OXO" process can be ethoxylated and employed as the viscosity and/or dispersibility modifiers of compositions herein.

F. Polyol Based Surfactants

Suitable polyol based surfactants include sucrose esters such sucrose monooleates, alkyl polyglucosides such as stearyl monoglucosides and stearyl triglucoside and alkyl polyglycerols.

The above nonionic surfactants are useful in the present compositions alone or in combination, and the term "nonionic surfactant" encompasses mixed nonionic surface active agents.

The nonionic surfactant is present in an amount from 0.01 to 15%, more preferably 0.1 to 12%, most preferably 0.35 to 10%, e.g. 0.5 to 7% by weight, based on the total weight of the composition.

Perfume

The compositions of the invention preferably comprise one or more perfumes. Typical perfumes suitable for use in the present invention are disclosed in "Perfume and Flavor Chemicals (Aroma Chemicals)", by Steffen Arctander, published by the author in 1969, the contents of which are incorporated herein by reference.

Preferably the perfume is present in an amount from 0.01 to 10 wt %, more preferably 0.05 to 7 wt %, most preferably 0.1 to 5 wt % based on the total weight of the composition.

A particularly preferred method for incorporating the perfume into the composition is described in U.S. Pat. No. 6,200,949, incorporated by reference herein.

Other Optional Ingredients

The compositions may also contain one or more optional ingredients conventionally included in fabric conditioning compositions such as pH buffering agents, perfume carriers, fluorescers, colourants, hydrotropes, antifoaming agents, antiredeposition agents, polyelectrolytes, enzymes, optical brightening agents, anti-shrinking agents, anti-wrinkle agents, anti-spotting agents, germicides, fungicides, anti-corrosion agents, drape imparting agents, anti-static agents, ironing aids, dyes and fatty acids.

Product Form

The compositions of the present invention are solids, such as powders, tablets or bars. It is particularly preferred that the solid is a free-flowing powder. Ideally the powder has a mean particle size of less than 1000 microns as this improves the flow and dispersion characteristics of the powder. More preferably the mean particle size is less than 700 microns. Preferably, the dynamic flow rate of the powder is greater than 90 ml/s and more preferably greater than 100 ml/s. Preferably the bulk density of the powder is less than 800 g/L.

Product Use

The product is preferably used in the rinse stage of a laundry process. It is envisaged that the product is suitable for use in hand rinsing or machine rinsing operations.

EXAMPLES

The invention will now be illustrated by the following non-limiting examples. Further modifications will be apparent to the person skilled in the art.

Samples of the invention are represented by a number. Comparative samples are represented by a letter.

All values are % by weight of the active ingredient unless stated otherwise.

Suitable methods for preparing the solid compositions are as follows:

In a first method, the carrier (e.g. urea) and other solids (zeolite and optional solids such as the citrate) are added to a mixer and mixed for 10–15 seconds. Suitable mixers include the Sirman C6 mixer granulator and the Fukae FS30 mixer. Other types of mixers could also be used including drum mixers, ploughshares and fluid bed mixers. The quaternary ammonium material is heated until molten and added to the solids in the mixer. Optional formulation aids, such as nonionic surfactant and tallow alcohol, can be co-melted with the quaternary ammonium material. Other optional ingredients, such as perfume and dye, are added separately to the solids. The mixture is then granulated for between 15–30 seconds and an optional flow aid may be added with a further 5 seconds mixing. If the composition is too wet it can be weathered to allow the liquid components to equilibrate within the powder structure, providing a dry free-flowing powder.

In an alternative process, the carrier (e.g. urea) is mixed with a powdered quaternary ammonium material. In this case the quaternary ammonium material is not melted. Other solids (zeolite and optional solids such as the citrate) are added and mixed. If required a binder, such as a nonionic surfactant or polyethylene glycol, can be added to improve granulation.

The following samples were prepared according to the first method above.

TABLE 1

| Sample | 1 | 2 | 3 |
|---|---|---|---|
| Urea (1) | 42.3 | 57.25 | 64.7 |
| Cationic Softener (2) | 25 | 25 | 25 |
| Zeolite 4A (3) | 29.9 | 14.95 | 7.5 |
| Flow aid (4) | 1.0 | 1.0 | 1.0 |
| Perfume | 1.8 | 1.8 | 1.8 |

(1) urea pure A, ex BASF
(2) Tetranyl AHT-1, ex Kao, where any solvent is removed by evaporation in a fume cupboard, and the solid milled using a Moulinex food mixer to give powder of mean particle size within range 200 to 600 $\mu$m.
(3) Wessalith P 80% active in 20% water, ex Crosfield
(4) Alusil, ex Crosfield Dispersion Analysis Dispersion of the solid in water was tested by adding 1.3 g of the powder to 1 liter of water at 20° C. in a glass beaker, followed by stirring using a magnetic stirrer. Each Product was then observed for its ability to disperse in water.

The results are given in table 2 below.

TABLE 2

| Time | Sample 1 | Sample 2 | Sample 3 |
|---|---|---|---|
| Initial | Milky | Milky | Very few particles |
| 30 Seconds | Particles at bottom | Particles at bottom | Particles at bottom |
| 180 seconds | Very few particles | Some particles | Large particles, less cloudy |

The sample with most zeolite gave the milkiest solution with fewest large particles remaining after stirring.

In the absence of zeolite, there is no initial cloudiness and large particles are clearly visible in the solution.

Powder Flow Analysis

The following samples were prepared according to the first method above.

TABLE 3

| Sample | A | B | C | 4 | 5 | 6 |
|---|---|---|---|---|---|---|
| Urea (1) | 77.2 | 72.2 | 67.2 | 57.2 | 52.2 | 47.2 |
| Cationic Softener (2) | 20 | 25 | 30 | 20 | 25 | 30 |
| Zeolite 4A (3) | 0 | 0 | 0 | 20 | 20 | 20 |
| Flow aid (4) | 1.0 | 1.0 | 1.0 | 1.0 | 1.0 | 1.0 |
| Perfume | 1.8 | 1.8 | 1.8 | 1.8 | 1.8 | 1.8 |

(1) as above
(1) as above
(1) as above
(1) as above

The dynamic flow rate (DFR) is measured for each sample using a DFR Mk1 instrument (Synatel Instruments Ltd). A flow rate above 100 ml/s is considered to be good.

Samples B and C had flow rates below 100 ml/s whereas the samples of the invention exhibited flow rates of 100 ml/s or higher.

What is claimed is:

1. A solid fabric conditioning composition comprising:

(a) from 15 to 75% by weight of cationic softening material (active ingredient), based on the total weight of the composition;

(b) from 17 to 70% by weight of urea carrier materials; and (c) 0.1 to 30% by weight of the composition of one or more zeolites; and (d) Further comprising a fatty alcohol.

2. A solid fabric conditioning composition as claimed in claim 1 comprising a deposition aid.

3. A solid fabric conditioning composition as claimed in claim 2 wherein the deposition aid is a salt.

4. A solid fabric conditioning composition as claimed in claim 1 wherein the cationic softening material comprises a quaternary ammonium compound.

5. A solid fabric conditioning composition as claimed in claim 1 wherein the solid is in the form of a powder having a mean particle size of less than 700 microns.

* * * * *